US008343621B2

(12) United States Patent
Murakami

(10) Patent No.: US 8,343,621 B2
(45) Date of Patent: Jan. 1, 2013

(54) METHOD AND APPARATUS FOR REMOVING IMAGE FROM RECORDING MATERIAL, AND IMAGE PEELING MEMBER FOR PEELING IMAGE FROM RECORDING MATERIAL

(75) Inventor: Kakuji Murakami, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/033,114

(22) Filed: Feb. 23, 2011

(65) Prior Publication Data

US 2011/0139376 A1 Jun. 16, 2011

Related U.S. Application Data

(62) Division of application No. 11/363,029, filed on Feb. 28, 2006, now Pat. No. 7,923,065.

(30) Foreign Application Priority Data

Mar. 14, 2005 (JP) ..... 2005-072007

(51) Int. Cl.
*B05D 5/00* (2006.01)

(52) U.S. Cl. ..... 428/271; 428/198; 428/369; 118/652; 118/261; 118/262; 355/299; 134/22.19; 134/38; 134/104.1; 134/201

(58) Field of Classification Search ..... 118/652, 118/261, 262; 355/299; 134/22.19, 38, 104.1, 134/201; 427/271, 369, 198
See application file for complete search history.

(56) References Cited

U.S. PATENT DOCUMENTS

| | | | | |
|---|---|---|---|---|
| 5,619,765 | A * | 4/1997 | Tokita et al. | 15/3 |
| 5,638,842 | A * | 6/1997 | Tokita et al. | 134/104.1 |
| 5,736,286 | A * | 4/1998 | Kaneko et al. | 430/124.15 |
| 7,923,065 | B2 * | 4/2011 | Murakami | 427/198 |
| 2005/0141906 | A1 | 6/2005 | Murakami | |

FOREIGN PATENT DOCUMENTS

| | | | |
|---|---|---|---|
| JP | 63-60662 | | 4/1988 |
| JP | 1-72374 | | 5/1989 |
| JP | 1-297294 | | 11/1989 |
| JP | 4-64472 | | 2/1992 |
| JP | 7-56472 | * | 3/1995 |
| JP | 7-287490 | | 10/1995 |
| JP | 8-16019 | | 1/1996 |
| JP | 9-197926 | * | 7/1997 |
| JP | 9-204060 | | 8/1997 |
| JP | 9-212050 | | 8/1997 |
| JP | 9-288440 | | 11/1997 |
| JP | 10-074025 | | 3/1998 |
| JP | 10-232588 | | 9/1998 |
| JP | 10-274909 | * | 10/1998 |
| JP | 11-073071 | | 3/1999 |
| JP | 2000-132019 | | 5/2000 |
| JP | 2002-214928 | | 7/2002 |
| JP | 2003-091090 | | 3/2003 |
| JP | 2004-286920 | | 10/2004 |

OTHER PUBLICATIONS

Office Action issued May 10, 2011, in Japanese Patent Application No. 2005-072007.

* cited by examiner

*Primary Examiner* — Leszek Kiliman
(74) *Attorney, Agent, or Firm* — Oblon, Spivak, McClelland, Maier & Neustadt, L.L.P.

(57) ABSTRACT

An image removing method including heating a recording material having thereon an image to a temperature so that the image has a plasticity; pressure-contacting an uppermost stream peeling member with the recording material while the image maintains a plasticity; separating the uppermost stream peeling member from the recording material to transfer at least a portion of the image to the uppermost stream peeling member; and repeating the heating, pressure-contacting and separating steps at least one more time using at least one downstream peeling member, wherein the uppermost stream peeling member has a first outermost layer which does not have a plasticity when being pressure-contacted with the recording material, and at least one of the at least one downstream peeling member has a second outermost layer which has a plasticity when being pressure-contacted with the recording material.

18 Claims, 4 Drawing Sheets

METHOD AND APPARATUS FOR REMOVING IMAGE FROM RECORDING MATERIAL, AND IMAGE PEELING MEMBER FOR PEELING IMAGE FROM RECORDING MATERIAL

CROSS-REFERENCE TO RELATED APPLICATIONS

The present application is a divisional application of U.S. application Ser. No. 11/363,029 filed on Feb. 28, 2006, now U.S. Pat. No. 7,923,065 and claims priority to Japanese priority document, 2005-072007 filed in Japan on Mar. 14, 2005, the entire contents of each of which are incorporated herein by reference.

BACKGROUND OF THE INVENTION

1. Field of the Invention

The present invention relates to a method and an apparatus for removing an image, which has been formed on a recording material using an image forming apparatus such as copiers, printers and facsimile machines, from the recording material. In addition, the present invention also relates to an image peeling member for peeling an image from a recording material.

2. Discussion of the Background

Recently, printers, analogue copiers, digital copiers and facsimile machines using electrophotography are broadly used, and a huge amount of paper is used therefor. Since paper is prepared using pulp, which is obtained from wood, use of such a huge amount of paper causes deforestation, resulting in deterioration of global environment. Therefore, it is a social issue to lower the consumption of paper. In addition, since there is a limit to waste disposal sites, it is also a social issue to reduce the amount of waste.

In attempting to resolve the issues, paper recycling methods in which disused information recording papers are collected and pulp prepared from the collected paper waste in paper factories is reused for new papers have been conventionally used. However, these paper recycling methods have drawbacks in that a large amount of energy is consumed for transporting the collected paper waste, preparing pulp using the waste paper and making new paper from the pulp; and the recycled paper has poor physical qualities such as low stiffness and whiteness, and produces images with poor image qualities such as formation of blurred images. In addition, when high quality information recording paper having high whiteness is prepared using recycled pulp, the manufacturing costs thereof are often higher than the costs of manufacturing such a high quality recording paper using a new raw materials. Further, when disused information recording paper is collected, there is a risk of occurrence of a problem in that information such as personal information written in the disused recording paper is disclosed to the public.

In attempting to solve the problem of the recycled paper, recording materials which can be reused by removing images therefrom and methods in which images formed on a recording material is removed to reuse the recording material have been proposed. For example, published unexamined Japanese patent application No. (hereinafter referred to as JP-A) 01-297294 discloses a technique in that an image formed on a recording material such as plastic films, metal foils, non-penetrative paper, and ceramics is heated while a thermofusible peeling member is overlaid on the image to be removed from the recording material. In addition, JP-A 04-64472 discloses a device which removes an image formed on a surface of a recording material by an electrophotographic method, which surface is treated with a release agent, by contacting a surface of an endless belt (serving as a peeling member), which surface includes a thermofusible resin, to the image to transfer the image from the recording material to the endless belt.

Although the means for removing images is described in these publications, means for treating the peeling member on which images are transferred is not described therein. Specifically, when images are accumulated on a peeling member, the heat capacity of the peeling member increases and the heat conductivity thereof deteriorates. Therefore, it is necessary to remove the images accumulated on the peeling member in order to repeatedly use the peeling member.

It is possible to remove images on a recording material using a peeling member having an outermost layer including a thermofusible or thermoplastic material. However, in this case the images are mixed with the thermofusible or thermoplastic material on the peeling member because both the images and the thermofusible or thermoplastic material have a fluidity, and therefore it is hard to separate the images from the thermofusible or thermoplastic material. Therefore, the above-mentioned image removing devices cannot be commercialized.

Images accumulated on a peeling member are not removed, not only cause increase in the heat capacity and deterioration of the heat conductivity of the peeling member, but also roughen the surface of the peeling member. When such a roughened peeling member is used, the surface of the peeling member cannot be contacted with the entire image to be removed from a recording material, thereby causing a problem in that a portion of the images remains on the recording material without being removed. Therefore, it is necessary to smooth the surface of the peeling member after every image removing operation. When the smoothing operation is performed on a peeling member, the thermofusible or thermoplastic material has to be heated to a relatively high temperature compared to the melting point or glass transition temperature of the thermofusible or thermoplastic material so that the material has a high fluidity. In this case, a large amount of energy is needed for performing this smoothing operation after every image removing operation. This also prevents the above-mentioned image removing devices from being commercialized.

In attempting to well remove images from recording materials, techniques in that removing operations are repeated several times have been proposed. For example, JP-A 07-56472 discloses a method and a device in which a liquid including water as a main component is coated on an image to destabilize the image by decreasing the adherence of the image to the recording material, and then two peeling members are repeatedly contacted with and separated from the destabilized image to remove the image from the recording material. The reason why the method uses two peeling members is as follows. When a solid image having a large area, on which the destabilizing liquid has been applied, is removed using one peeling member, peeling is not caused at the interface between the image and the recording material and is caused within the recording material. This is because the binding force among the cellulose fibers constituting the recording material decreases due to swelling of the fibers. Therefore, the method uses two peeling members, one of which is located on an upstream side relative to the feeding direction of the recoding material and which is configured to adhere to a part of the image to remove the part of the image from the recording material. The other peeling member, which is located on a downstream side, is configured to adhere to the entire surface of the solid image to remove the residue of the solid image.

It is described in JP-A 07-56472 that a resin which is the same as or similar to the resin including in the toner constituting the image to be removed is used for the surface of the peeling member and in addition the area of the image removing portions of the surface of the two peeling members, which portions have an image removing ability and can be contacted with the image to be removed is changed. However, it is not described therein to use both a peeling member having an thermoplastic surface and a peeling member having a non-thermoplastic surface. In addition, it is not described therein to use different cleaning members for removing the images transferred to the two peeling members.

Although (monochrome) images constituted of a toner having a relatively large particle diameter can be removed relatively well by this method, images constituted of a toner having a relatively small volume average particle diameter of not greater than 8 μm, multicolor toner images and half tone images cannot be well removed. For example, multicolor images typically include secondary or tertiary images (i.e., images such as two or three different color images are overlaid), which are relatively thick, and half tone images which are relatively thin. If a secondary or tertiary image is located adjacent to a half tone image, the half tone image is hardly contacted with such peeling members, and thereby the half tone image cannot be well removed. Particularly, a peeling member using a material, such as resins having a high glass transition temperature (Tg) and metals, which does not achieve a plasticity at the temperature to which the peeling member is heated to remove an image, cannot remove such a multi-color image or an image constituted of a toner having a relatively small particle diameter.

JP-A 09-212050 discloses a device in which an image removing operation is performed plural times to remove an image from a recording material using a thermal transfer method and then the toner particles scattered around the image (i.e., toner particles located on a background portion of the image near the image portion) are removed using electrostatic force. It is described therein that the toner particles on the background portion cannot be removed from the recording material by performing the thermal transfer peeling operation plural times. However, almost all the toner particles located on a background portion are also thermally fixed with a fixing device, and therefore such toner particles are hardly removed by such an electrostatic force as mentioned in JP-A 09-212050. Particularly, in a multi-color image the upper toner layers of a secondary or tertiary color image has to be transparent so that the color image has good color reproducibility, and therefore the upper toner layers are fully melted. Therefore, a color image is fixed on a recording material relatively strongly compared to a monochrome image. Therefore color toner particles on a background portion cannot be removed by such an electrostatic force.

JP-A 09-212050 points out that removal of toner particles scattered around images is only a problem to be solved. However, when a cycle of recording an image on a recording material and removing the image from the recording material to reuse the recording material is repeated many times, toner particles located on the entire background area (i.e., background fouling) have to be removed. All images formed on recording materials using electrophotographic image forming apparatuses have background fouling which is constituted of toner particles. When the above-mentioned cycle is performed several times, the toner particles remaining on a background portion without being removed are not so noticeable. However, when the cycle is performed a number of times, the toner particles are accumulated on the recording material, resulting in increase of the background density. Therefore, the resultant image formed on such a recording material is visually undesirable. When such an image is removed to reuse the recording material, a problem which occurs is that a negative image of the image portion is formed on the recording material because the toner particles under the image portion are removed but the toner particles on the background area remains on the recording material. This is also a problem in view of security.

In particular, the problem in that toner particles remain on background areas without being removed and the toner particles are accumulated on the recording material occurs if the toner particles have a volume average particle diameter of not greater than 8 μm and/or the toner particles are present on a background area near a multi-color image.

Further, JP-As 09-197926 and 10-274909 have disclosed image removing methods and apparatuses in which an operation cycle of performing attaching, pressing and detaching of a peeling member on a recording material is carried out plural times. The techniques described therein are similar to that of JP-A 07-56472 mentioned above although the purposes thereof are different from each other. Therefore, the techniques are not effective for removing images having secondary or tertiary color images and half tone images; and for removing toner particles (image forming materials) present on background areas.

Because of these reasons, a need exists for an image removing method by which images having secondary or tertiary color images and half tone images; and toner particles present on background areas can be well removed.

SUMMARY OF THE INVENTION

As one aspect of the present invention, an image removing method is provided which includes:

heating a recording material having thereon an image including a thermoplastic material to a temperature at which the thermoplastic material has a plasticity;

pressure-contacting a first outermost layer of an uppermost stream peeling member with a surface of the recording material on which the image is formed while the thermoplastic material in the image maintains a plasticity;

separating the uppermost stream peeling member from the recording material to peel the image with the uppermost stream peeling member, resulting removal of the image from the recording material; and repeating the heating, pressure-contacting and separating at least one more time using at least one downstream peeling member, wherein the first outermost layer of the uppermost stream peeling member does not have a plasticity in the pressure-contacting process, and at least one of the at least one downstream peeling member has a second outermost layer which has a plasticity in the pressure-contacting process.

As another aspect of the present invention, an image removing apparatus is provided which includes:

a heating device configured to heating a recording material having thereon an image including a thermoplastic material to a temperature at which the thermoplastic material has a plasticity; and at least two image removing devices which are arranged in series in a feeding direction of the recording material, each of the at least two image removing devices including:

a peeling member configured to peel at least a portion of the image from the recording material;

a pressing member configured to pressure-contact the peeling member with a surface of the recording material on which the image is formed while the thermoplastic material in the image maintains a plasticity; and a transfer member configured to separate the peeling member from the recording material to transfer the portion of the image to the peeling member, wherein the uppermost stream peeling member has a first outermost layer which does not have a plasticity when the first outermost layer is pressure-contacted with the recording material, and at least one downstream peeling member has a second outermost layer which has a plasticity when the second outermost layer is pressure-contacted with the recording material.

As yet another aspect of the present invention, an image peeling member for peeling an image from a recording material is provided which includes:

a paper substrate; and a thermoplastic resin layer which is present on a surface of the paper substrate and which is configured to peel the image from the recording material by being pressure-contacted with an image on a recording material at a temperature in which the thermoplastic resin layer has a plasticity.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
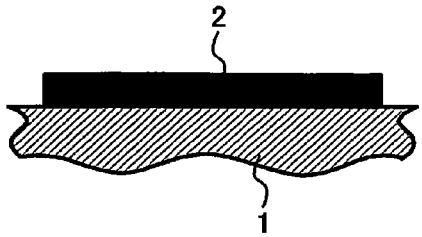
FIGS. 1A-1E are schematic cross-sectional views illustrating examples of recording materials bearing an image thereon.

The present invention relates to an image removing method and an image removing apparatus in which an image formed on a recording material is removed therefrom. In addition, the present invention also relates to an image peeling member for use in the image removing apparatus, which separate an image from a recording material. Particularly, the present invention relates to an image removing method and an image removing apparatus in which an image including a thermoplastic material formed on a recording material using electrophotography is removed from the recording material.

However, the method and apparatus of the present invention are not limited to images formed by electrophotography, and can be used for all images including a material having a thermoplasticity and a proper viscoelasticity. Specifically, the method and apparatus of the present invention can be used for removing images produced by a method such as thermal transfer methods, gravure printing methods, inkjet recording methods (particularly inkjet recording methods using a hot melt ink), and offset printing methods as long as the images include a material having a thermoplasticity and a proper viscoelasticity.

In addition, the image removing method and apparatus of the present invention are not limited to images formed on sheet-form recording materials, and can be used for images formed on web-form recording materials and endless recording materials. Further, the image removing method and apparatus of the present invention can also be used for images on display media, which are repeatedly formed and erased on the display media.

In the present invention, an image removing method is provided which includes:

heating a recording material having thereon an image including a thermoplastic material to a temperature at which the thermoplastic material has a plasticity;

pressure-contacting a first outermost layer of an uppermost stream peeling member with a surface of the recording material on which the image is formed while the thermoplastic material in the image maintains a plasticity;

separating the uppermost stream peeling member from the recording material to peel the image with the uppermost stream peeling member, resulting removal of the image from the recording material; and repeating the heating, pressure-contacting and separating at least one more time using at least one downstream peeling member, wherein the first outermost layer of the uppermost stream peeling member does not have a plasticity when being pressure-contacted with the recording material, and at least one of the at least one downstream peeling member has a second outermost layer which has a plasticity when being pressure-contacted with the recording material.

It is preferable for the image removing method to further include:

removing the image transferred to the outermost layer of the uppermost stream peeling member after every image peeling operation of the uppermost stream peeling member. In this case, it is possible to intermittently perform a cleaning operation on the downstream peeling member(s), i.e., not to remove the image transferred to the outermost layer of the downstream peeling member(s) after every image peeling operation of the downstream peeling member(s).

It is preferable that the temperature of the uppermost stream peeling member at which the uppermost stream peeling member is pressure-contacted with the recording material is higher than the temperature of the downstream peeling member at which the downstream peeling member is pressure-contacted with the recording material.

The image removing method and apparatus of the present invention can be used for removing images prepared using a developer (such as toner) having a volume average particle diameter of not greater than 8 μm (from 3 to 8 μm, and preferably from 5 to 8 μm in view of preparation of the developer and developing efficiency).

The image removing method and apparatus of the present invention can be used for removing multi-color images including a thermoplastic material, in which the thicknesses of the color images are largely different from the others.

The surface of the recording material can include a layer which can decrease the adhesiveness of the image to the recording material. Alternatively, a material which can decrease the adhesiveness of the image to the recording material can be penetrated into the recording material.

As another aspect of the present invention, an image removing apparatus is provided which includes:

a heating device configured to heating a recording material having thereon an image including a thermoplastic material to a temperature at which the thermoplastic material has a plasticity; and at least two image removing devices which are arranged in series in a feeding direction of the recording material, each of the at least two image removing devices including:

a peeling member configured to peel at least a portion of the image from the recording material;

a pressing member configured to pressure-contact the peeling member with a surface of the recording material on which the image is formed while the thermoplastic material in the image maintains a plasticity; and a transfer member configured to separate the peeling member from the recording material to transfer the portion of the image to the peeling member, wherein the uppermost stream peeling member has a first outermost layer which does not have a plasticity when the first outermost layer is pressure-contacted with the recording material, and at least one downstream peeling member has a second outermost layer which has a plasticity when the second outermost layer is pressure-contacted with the recording material.

The apparatus preferably includes a cleaner configured to remove the image on the uppermost stream peeling member. It is preferable that the cleaner continuously performs the cleaning operation when a long or endless recording material is used, and performs the cleaning operation after every image peeling operation in which an image is transferred from a sheet-form recording material to the peeling member.

The apparatus preferably includes a cleaner configured to remove the image on the downstream peeling member (or members) located on a downstream side. It is preferable that the apparatus further includes a controller controlling the cleaner so as to intermittently perform the cleaning operation only after an image is transferred to the peeling member. Alternatively, the controller can control the cleaner so as to perform the cleaning operation when the thickness of the images on the downstream peeling member measured by a detector exceeds a predetermined thickness. Alternatively, the controller can control the cleaner so as to perform the cleaning operation when the amount of the image forming materials remaining on a recording material even after the image peeling operations, which is measured by a detector, exceeds a predetermined amount. Alternatively, the controller can control the cleaner so as to perform the cleaning operation when the image removing operation is performed predetermined times, wherein the number of the image removing operation is counted with a counter. In this case, the controller resets the counter after a cleaning operation is performed on the peeling member.

The controller can control the cleaner so as to perform the cleaning operation when the downstream peeling member does not perform an image removing operation. Alternatively, a heating device is provided to heat the downstream peeling member and the controller controls the temperature of the peeling member so as to be relatively high in the cleaning operation compared to the temperature at which the peeling member performs the image removing operation.

The cleaner for cleaning the downstream peeling member preferably includes a pressing member configured to press the surface of the peeling member so that the images on the peeling member move to an end of the peeling member; and a scraper configured to scrape off the images at the end of the peeling member.

It is possible not to provide a cleaner for removing the images on the downstream peeling member.

It is preferable that the downstream peeling member has a paper substrate including cellulose fibers as a main component or the downstream peeling member is a sheet-form web having plural surfaces having an image peeling function.

It is preferable that the image removing apparatus further includes a heating member configured to heat the peeling members such that the temperature of the downstream peeling member performing the image peeling operation is lower than the temperature of the uppermost stream peeling member performing the image peeling operation.

It is possible to provide a controller configured to order the downstream peeling member to perform or not to perform the image removing operation by providing an attaching and detaching member configured to attach the downstream peeling member to the recording material and detach the peeling member therefrom; or to control the temperature of the peeling member by providing a heater configured to heat the downstream peeling member. In this case, it is possible that a history detecting member configured to determine the history of the recording material is provided and the controller controls the attaching and detaching member or the heating member so that the downstream peeling member performs the image removing operation depending on the history of the recording material.

As yet another aspect of the present invention, an image peeling member for peeling an image from a recording material is provided which includes a paper substrate and a thermoplastic resin layer located on a surface of the paper substrate. The thermoplastic resin layer can be located on both sides of the paper substrate. It is preferable that the image peeling member further includes a colorant, and more preferably a black colorant.

Next, the image removing method and apparatus of the present invention will be explained in detail.

The present invention relates to an image removing method, and an image removing apparatus for removing an image formed on a recording material using an image forming method such as electrophotography. However, the method, apparatus and peeling member are not limited to such images and can be used for removing images having a considerable thickness and a thermoplasticity even if the images are produced by a method other than electrophotography.

Since images produced by the marketed image forming apparatuses are typically constituted of a toner powder, the images satisfy the above-mentioned requirements. In this regard, the image forming apparatuses are not limited to electrophotographic image forming apparatuses in which a toner image is formed by developing an electrostatic image formed on a photoreceptor with a toner; transferring the toner image onto a recording material; and fixing the toner image on the recording material upon application of heat and pressure thereto. For example, the present invention can be applied to the following toner images:

(1) a toner image formed by developing, with a toner, an electrostatic image formed on a dielectric recording material using a method in which a pin electrode is directly contacted with the dielectric recording material to form the electrostatic image or a method in which ions are applied by an electrode to the dielectric recording material while the amount of ions is controlled to form the electrostatic image; and (2) a toner image formed on a recording material by directly ejecting toner particles toward the recording material while controlling the amount of the toner particles using an electrode.

In addition, magnetic recording methods, thermal transfer recording methods, and inkjet recording methods which use a hot melt ink and in which an ink is adhered to an intermediate transfer medium and then the ink image is transferred to a recording material typically use a developer including a thermoplastic material. Therefore the image removing method and apparatus of the present invention can be used for the images produced by the methods.

Further, the present invention can be used for images produced by a method such as gravure printing methods, offset printing methods, screen printing methods as long as the inks have a viscoelasticity suitable for the image removing method and apparatus of the present invention.

The materials for use in the recording material are not particularly limited. Specific examples of the materials include papers including cellulose fibers as a main component, and films such as polyethylene terephthalate films, overhead projection films, and microfilms. Specific examples of the papers include plain papers, printing papers, coated papers such as art papers, etc. However, it is preferable to use so-called "reusable papers" or "reusable media" which includes a substrate and an adhesion decreasing agent which is configured to decrease the adhesiveness of an image forming material (such as toners) to the substrate and which is coated on the substrate.

In order to well remove an image formed on a plain paper or a printing paper, it is preferable to coat an image removal accelerating agent on the surface of the paper before removing the image therefrom. Even when such an image removal accelerating agent is coated on the surface of a paper, there is a case where the image cannot be well removed therefrom if there is an air gap between the image and the paper. This problem tends to occur if the image is a multi-color image.

The image removing method and apparatus of the present invention remove an image from a recording material using a thermal transfer method. Specifically, the image removing method of the present invention typically include the following processes as main processes:

(1) a process in which the recording material is heated to a temperature at which the image has a plasticity;

(2) a process in which a peeling member is pressure-contacted with a surface of the recording material bearing the image thereon while the thermoplastic material in the image maintains a plasticity; and (3) a process in which the peeling member is separated from the recording material to transfer the image to the uppermost stream peeling member, resulting removal of the image from the recording material.

The process (2) is performed before the process (3). The process (1) can be performed before or after the process (2).

The processes (1)-(3) are repeated several times (i.e., at least twice) using a plurality of peeling members. When the processes (1)-(3) are performed twice, the upstream peeling member has an outermost layer which does not have a plasticity in the pressure-contacting process, and the downstream peeling member has an outermost layer which has a plasticity in the pressure-contacting process. When a reusable medium is used as the recording material, images thereon can be well removed by performing the processes (1)-(3) twice.

When the uppermost stream peeling member has an outermost layer which has a plasticity in the pressure-contacting process, the most part of the image is transferred to the uppermost stream peeling member, and therefore it becomes hard to clean the surface of the uppermost stream peeling member.

When the processes (1)-(3) are performed three or more times, at least the first (uppermost stream) peeling member has an outermost layer which does not have a plasticity in the pressure-contacting process, and at least the last peeling member has an outermost layer which has a plasticity in the pressure-contacting process, to well remove the image from the recording material. In this case, the intermediate peeling member(s) other than the first and last peeling members has an outermost layer which has a plasticity in the pressure-contacting process or an outermost layer which does not have a plasticity in the pressure-contacting process. However, it is preferable for the intermediate peeling member(s) to include an outermost layer which does not have a plasticity in the pressure-contacting process because the burden on the cleaner(s) for removing the images transferred to the peeling member(s) can be lightened.

By using the image removing method mentioned above, significant portion of the image can be removed by the uppermost stream peeling member. Specifically, almost all the images such as solid images, character images and half tone images having a middle or high image density can be removed by the uppermost stream peeling member. The residual images are removed by the downstream peeling member(s). The half tone images having a low density, the background fouling (such as toner particles present around the image and in the background area), and images having a small thickness can be removed by the downstream peeling member(s).

Thus, the images on the recording material (including background fouling) can be removed substantially perfectly by the image removing method mentioned above. Therefore, even when a cycle of image formation and image removal is repeatedly performed on a recording material, occurrence of a problem in that a portion of images remains on the recording material can be prevented. Since particles of the image forming material (such as toner particles) present in the background area can be well removed even if the particles are present alone on the recording material, the above-mentioned problem in that the previously recorded image can be read as a negative image, resulting in leaking of the image information, is not caused. Therefore, the recording material can be repeatedly used safely even if the user of the recording material is changed.

The reason why an image can be well removed from a recording material will be explained.

Recently, electrophotographic image forming apparatuses such as printers and copiers, which use a digital image forming method using a light emitting device such as laser diodes (LDs), light emitting diodes (LEDs), liquid crystal shutters, etc., have been broadly used.

Figure 1B:
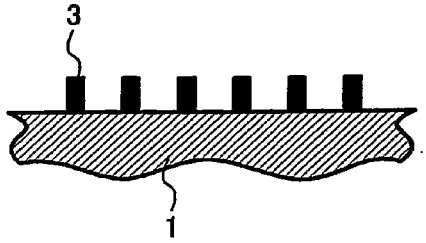
Figure 1C:
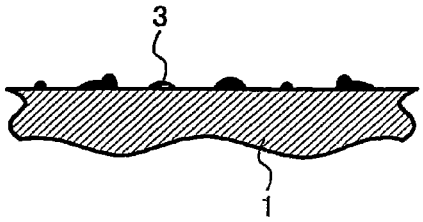

FIGS. 1A-1E illustrate cross-sections of various images formed on a recording material. FIG. 1A is a schematic view illustrating a solid image formed and fixed on a recording material by electrophotography. In FIG. 1A, numerals 1 and 2 denote a recording material and a solid image formed on the recording material 1, respectively. FIG. 1B is a schematic view illustrating a half tone image formed on a recording material by a digital electrophotographic image forming method (binary recording). In FIG. 1B, numeral 3 denotes a dot image constituting the half tone image. In half tone images recorded by an analogue electrophotographic image forming method, the densities of the half tone images are changed by changing the height of the half tone images. In contrast, in half tone images recorded by a digital electrophotographic image forming method, it is ideal that the height of the dot images are the same as that of a solid image. However, in reality the half tone images produced by an analogue electrophotographic image forming method have a structure as illustrated in FIG. 1C, wherein the heights of the dot images of a half tone image are lower than that of a solid image and vary.

Figure 1D:
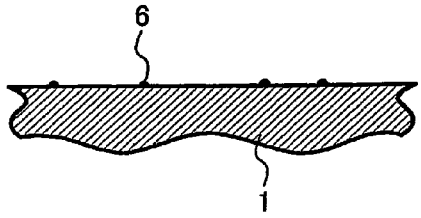

FIG. 1D is a schematic view illustrating the cross section of a background area of a recording material on which particles of an image forming material such as toners are present while separated from each other. In FIG. 1D numeral 6 denotes a particle of an image forming material.

Each of half tone images formed by an analogue electrophotographic image forming method ideally has the same thickness. However, since the particle diameter of the image forming material is relatively large compared to the desired thickness of a half tone image, the half tone image does not have a uniform thickness in reality. Specifically, a half tone image is constituted of a thick image portion, a thin image portion and a non-image portion.

In order to well remove images on a recording material using a thermal transfer method, it is essential that the peeling member is contacted with the images. According to the present inventor's study, all the images cannot be removed by only one image removing operation even when the recording material has a flat surface as illustrated in FIGS. 1A-1E. This is because the heights of the images are different as illustrated in FIG. 1C. In addition, in multi-color images, the heights of the images vary more largely than in monochrome images because the color images have secondary or tertiary color images in which two or three toner layers are overlaid. Therefore, it is more difficult to well remove a multi-color image from a recording material.

Figure 1E:
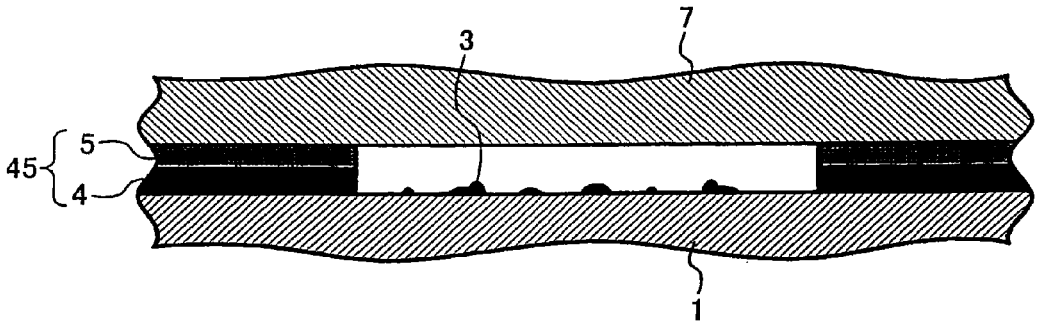

FIG. 1E is a schematic view illustrating the cross section of a multi-color image. In FIG. 1E numerals 4 and 5 denote color image layers constituting a secondary color image 45, and numeral 7 denotes a peeling member. Numeral 3 denotes a half tone image which is sandwiched by two secondary color solid images. When the peeling member 7 contacts and heats the color image 45 upon application of pressure thereto, the image forming materials 4 and 5 have a plasticity and flow away toward the half tone image 3, and thereby the height of the color image 4 and 5 is lowered. However, the height of the color image 4 and 5 is not lowered to an extent such that both of the color image 4 and 5 and the half tone image 3 can be removed from the recording material 1 under the general image removing conditions (such as heating conditions and processing speed). Particularly, when such an image as illustrated in FIG. 1E is removed using a peeling member having an outermost layer having no thermoplasticity, it is hard to contact the surface of the peeling member to all the surfaces of the color image 45 and half tone image 3.

According to the present inventor's study, it is found that even when an image is formed on a flat recording material, the image cannot be perfectly removed by repeating a removing operation using one or more peeling members each having an outermost layer having no plasticity. Particularly, low density half tone images, image forming materials scattered around images, and image forming materials in background areas cannot be perfectly removed by such a peeling member. By performing a removing operation using a peeling member having an outermost layer having a plasticity after performing a removing operation using a peeling member having an outermost layer having no plasticity, the image can be almost perfectly removed. Thus, the present invention is made.

In the image removing method and apparatus of the present invention, significant portion of the image can be removed by the uppermost stream peeling member. The images transferred to the uppermost stream peeling member can be easily removed therefrom because the outermost layer has no plasticity and therefore a clear interface is present between the outermost layer of the peeling member and the transferred images. In addition, since the heat expansion coefficient of the peeling member is different from that of the image forming material, the transferred image forming material can be easily removed by changing the temperature of the peeling member when removing the transferred image forming material because a large shearing force is formed between the peeling member and the image forming material transferred thereon. The image forming material on the peeling member can be easily removed therefrom using a blade, a rotating brush, a rotating spiral edged tool, etc. When removing the transferred image forming materials, the temperature of the peeling member is preferably lower than the temperature at which the image peeling operation is performed. In this case, the shearing force increases and thereby the transferred image forming materials can be easily removed from the peeling member.

Since a small amount of image forming material is transferred to the downstream peeling member(s), it is not necessary to continuously remove the transferred image forming materials or to intermittently remove the materials after every image peeling operation. Since higher images (such as the image 45 illustrated in FIG. 1E) are removed by the uppermost stream peeling member, only lower images (such as the image 3 in FIG. 1E) are removed by the downstream peeling member(s). Therefore, the surface of the downstream peeling member(s) is not roughened even after the image peeling operation, and the peeling member can well remove (peel) an image from a recording material even when the cleaning is not frequently performed.

First embodiment of the image removing apparatus will be explained referring to FIG. 2. The image removing apparatus includes an endless belt peeling member serving as a downstream peeling member.

The image removing apparatus includes an upstream image removing device including a pressure roller 211, a heat roller 212, a heater 213, a peeling member 217, a separating block 214, a tension roller 215, a cleaning backup roller 216, a cleaning blade roller 310, and a container 219. The surface of the peeling member 217 has no plasticity at the temperature in which the peeling member is contacted with an image to be removed from a recording material 200.

The pressure roller 211 has, for example, a structure such that a heat resistant elastic layer made of a material such as silicone rubbers and having a thickness of 3 mm is formed on a roller made of a metal such as aluminum and stainless steel and having a diameter of 35 mm and a thickness of 3 mm. A pressure is applied between the pressure roller 211 and the heat roller 212 using a pressing device (not shown) such as springs, and pressing devices such as water pressurizers and air pressurizers to pressure-contact the peeling member 217 with the surface of the recording material 200 bearing an image thereon.

The heat roller 212 is, for example, a roller made of a metal such as aluminum and stainless steel and having a diameter of 35 mm and a thickness of 3 mm. The surface of the roller is preferably coated with, for example, a fluorine-containing resin so that foreign materials such as image forming materials and dusts are not adhered to the surface. The heater 213 located inside the heat roller 212 includes, for example, a halogen lamp, an infrared lamp, or the like heater. The temperature of the surface of the heat roller 212 is measured with a temperature detector (not shown). The temperature information is input to a controller (not shown), to control the heat generation of the heater 213, thereby controlling the temperature of the heat roller 212 so as to be a predetermined temperature.

The peeling member 217 has an endless form, and is tightly stretched by the heat roller 212, the separating block 214, the tension roller 215, and the cleaner backup roller 216. The tension roller 215 is pressed by a pressing device (not shown) to apply a predetermined pressure to the peeling member 217. The peeling member 217 has a greater adhesion force against an image than the adhesion force between the image and the recording material from which the image is to be removed. In this embodiment, the peeling member 217 is an endless belt having a thickness of from 75 to 300 μm. Specific examples of the belt include films of polymers such as polyethylene terephthalate, polyethylene naphthalate, polyimide, polysulfone, polyether ether ketone, and polyphenylene sulfide. The polymers does not have a plasticity at a temperature of from 60 to 150° C., at which general image forming materials (such as toners) can be transferred to the peeling member. In addition, the peeling member 217 can be made of a metal such as nickel and stainless steel.

The pressure roller 211 is engaged with a motor (not shown) via a gear system (not shown) to be rotated. The tension roller 215 and the cleaner backup roller 213 are rotated by the rotation of the pressure roller 211, and thereby the peeling member 217 is rotated at a linear speed of from 15 to 150 mm/sec.

Figure 3B:
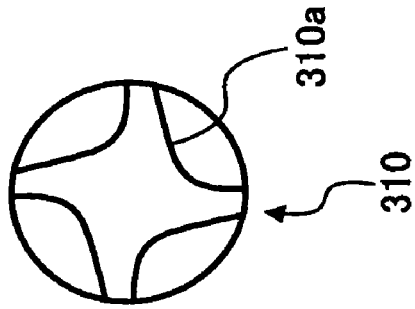
FIG. 3 is a schematic view illustrating a cleaning blade for use in the image removing apparatus of the present invention.
Figure 3A:
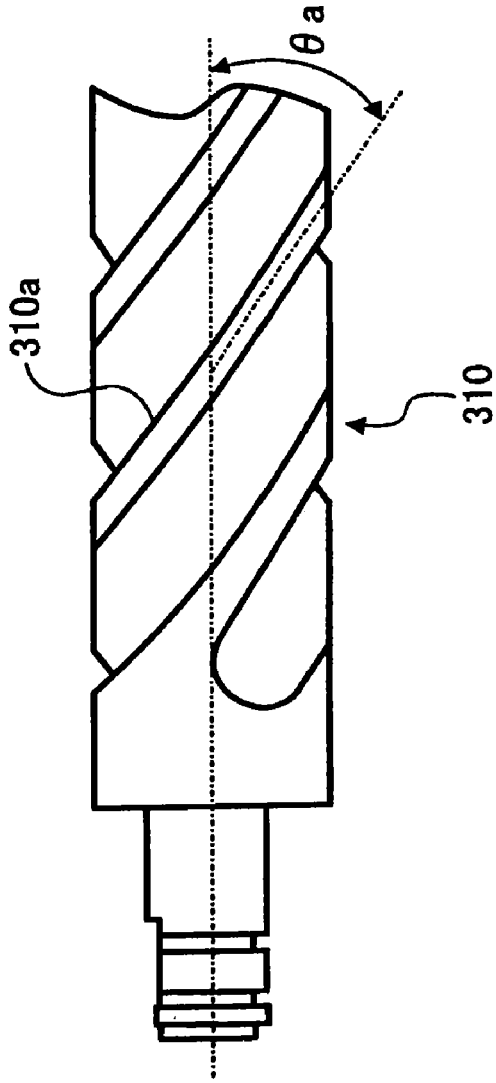

The cleaning blade roller 310 has, for example, a structure as illustrated in FIGS. 3A and 3B, i.e., a blade roller made of a steel for use in cutting tools and having a diameter of 25 mm, wherein the blade roller has a spiral edge 310*a*. The cleaning blade roller 310 is rotated in the direction opposite to the rotation direction of the peeling member 217 or in the same direction as the rotation direction of the peeling member 217 while the rotation speed is differentiated from that of the peeling member 217, to remove the image forming materials from the surface of the peeling member 217. The cleaner backup roller 216 has an elastic layer having a low hardness on the surface portion thereof. The cleaner backup roller 216 is pressured toward the cleaning blade roller 310 by a pressing device (not shown) such as springs, water pressurizers and air pressurizers. Thus, a nip is formed between the cleaner backup roller 216 and the cleaning blade roller 310 with the peeling member therebetween. An image forming material 230, which is scraped off from the peeling member 217 by the cleaning blade roller 310 is contained in the container 219.

Figure 2:
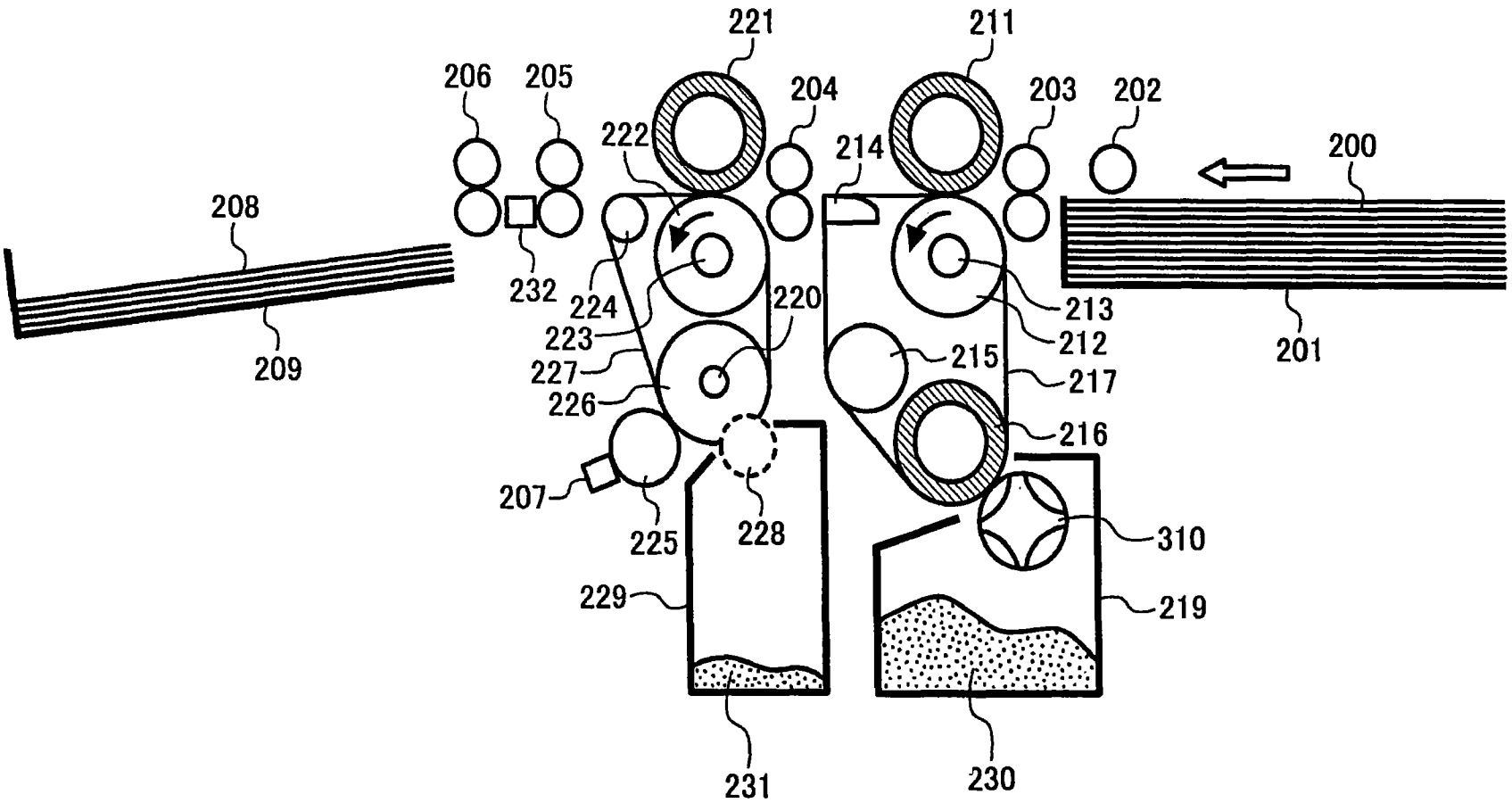
FIG. 2 is a schematic view illustrating an example of the image removing apparatus of the present invention.

As illustrated in FIG. 2, the image removing apparatus includes a downstream removing device which includes a pressure roller 221, a heat roller 222, a heater 223, a peeling member 227, a separating roller 224, an image forming material pressing roller 225, a cleaning backup roller 226, a cleaning blade 228 and a container 229. The surface of the peeling member 227 has a plasticity at the temperature in which the peeling member 227 is contacted with the recording material 200. Similarly to the pressure roller 211, the pressure roller 221 has an elastic layer on the surface thereof made of, for example, a silicone rubber, and is pressed toward the heat roller 222 by a pressing device such as springs, water pressurizers and air pressurizers. Therefore, the peeling member 227, which is heated by the heat roller 223, is pressure-contacted with the recording material 200.

Similarly to the upstream image removing device, the heater 223 located inside the heat roller 222 includes, for example, a halogen lamp, an infrared lamp, or the like heater. The temperature of the surface of the heat roller 222 is measured with a temperature detector (not shown). The temperature information is input to a controller (not shown), to control the heat generation of the heater 223, thereby controlling the temperature of the heat roller 222 so as to be a predetermined temperature.

The peeling member 227 has an endless form, and is tightly stretched by the heat roller 222, the separating roller 224, and the cleaning backup roller 226. The separating roller 224 is pressed by a pressing device (not shown) to apply a predetermined pressure to the peeling member 227. The separating roller 224 has a diameter of about 10 mm. The peeling member 227 is fed along the separating roller 224, but the recording material 200 goes straight because of having a stiffness. Thus, the recording material 200 is separated from the peeling member 227.

In the upstream image removing device, the separation block 214 has a small curvature because the adhesion force of the image to the peeling member 217 is strong. However, the curvature of the separating roller 224 in the downstream peeling member is larger than that of the separation block 214 because significant portion of the image on the recording material 200 is removed by the upstream image removing device, and thereby the adhesion force of the image to the peeling member 217 is relatively weak. By increasing the curvature of the peeling member 227 at the separating roller 224 as much as possible, the stress on the peeling member 227 at the separating roller 224 can be decreased, thereby prolonging the life of the peeling member 227.

Similarly to the peeling member 217, the peeling member 227 has an endless belt having a thickness of from 75 to 300 μm. However, on the surface of the peeling member 227, a thermoplastic resin layer having a plasticity at a temperature of from 60 to 160° C., at which general image forming materials (such as toners) can be transferred to the peeling member, is formed. The adhesion force between the resin layer and the substrate of the peeling member has to be greater than that between the image and the recording material. Specific examples of the substrate include films of polymers such as polyethylene terephthalate, polyethylene naphthalate, polyimide, polysulfone, polyether ether ketone, and polyphenylene sulfide. It is preferable that the substrate is roughed by being subjected to a sand blasting treatment or is subjected to a treatment such as corona discharging, ultraviolet irradiation, ion irradiation, electron beam irradiation, oxidation treatments, etc., to enhance the adhesiveness between the substrate and the resin layer thereon. Specific examples of the resins for use in the resin layer include polyvinyl acetate resin, ethylene-vinyl acetate resins, styrene-acrylic resins, polyester resins, nylon, etc.

Since at least the surface portion of the resin layer is mixed with image forming materials in the image removing operation, a resin similar to the resin constituting the image is preferably used for the resin layer. In this case, the formula of the resin layer is hardly changed even after long repeated use, and therefore the peeling member can stably carry out the image removing function.

The image forming material pressing roller 225 has a roller of a metal such as aluminum and stainless steel having structure such that the diameter of the center thereof is larger than that of both ends or the diameter of one end thereof is larger than that of the other end. The pressing roller 225 is pressed toward the cleaning backup roller 226 by a pressing device (not shown) such as springs, water pressurizers and air pressurizers. When the surface of the peeling member 227 is cleaned, the pressing roller 225 is pressed toward the cleaning backup roller 226. In this case, the image forming material on the peeling member 227 is moved toward both the end portions (or one end) of the peeling member 227, which face the narrow portions of the pressing roller 225.

The cleaning backup roller 226 includes therein a heater 220, such as a halogen lamp and an infrared lamp. The temperature of the surface of the cleaning backup roller 226 is measured with a temperature detector (not shown). The temperature information is input to a controller (not shown), to control the heat generation of the heater 220, thereby controlling the temperature of the cleaning backup roller 226 so as to be a predetermined temperature. The heater 220 is activated to heat the thermoplastic layer, resulting in increase of the fluidity of the thermoplastic layer on the peeling member 227, when the peeling member 227 is subjected to a cleaning treatment. By activating the heater 220 so that the temperature of the thermoplastic layer on the peeling member 227 becomes higher than the temperature at which the image on the recording material is removed by the peeling member 227, the image forming materials transferred on the thermoplastic layer can be easily removed therefrom.

In order to well transfer an image on the recording material 200 to the peeling member, it is preferable to perform the image transfer operation at a time when the thermoplastic layer has a considerable degree of elasticity and a high cohesive force. If the image transfer operation is performed when the thermoplastic layer is heated to a relatively high temperature and therefore the layer has a low cohesive force, a part of the thermoplastic layer is adhered to the recording material and a part of the image remains on the recording material. In contrast, when the image forming materials transferred on the peeling member are removed therefrom, the thermoplastic layer is preferably heated to a temperature 20 to 90° C. higher than the temperature of the thermoplastic layer at the image transfer operation, to efficiently perform the cleaning operation. In this case, a part of the thermoplastic layer is removed together with the image forming materials.

Figure 5:
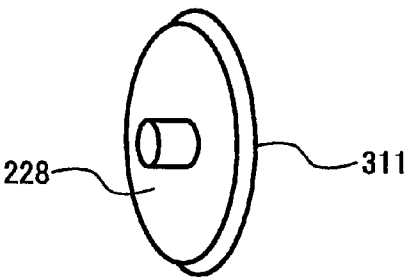
FIG. 5 is a schematic view illustrating a cutting blade for use in the image removing apparatus of the present invention.

The cleaning operation for the downstream peeling member 227 is controlled so as not to be performed when the image transfer operation is performed. Unlike the cleaning blade 310 which scrapes off the image forming materials, the cleaning blade 228 removes the image forming materials which have been moved to an end portion or both end portions of the peeling member 227 by the image forming material pressing roller 225. Therefore, the cleaning blade 228 is, for example, a thin cutting blade as illustrated in FIG. 5. The cleaning blade 228 illustrated in FIG. 5 has a cutting surface 311 and the cutting surface 311 is set so as to contact the side of the peeling member 227 to remove the image forming materials on the side of the peeling member 227. When the cleaning operation is not performed, the cleaning blade 228 is detached from the peeling member 227 with detaching means (not shown) and a controller of the detaching means (not shown).

It is hard to remove the image forming materials on the entire surface of the peeling member 227 without moving the image forming materials to an end or both ends of the peeling member, for example, by using a thickness controlling member. The reason is as follows. The image forming materials on the peeling member are united with a surface portion of the thermoplastic layer of the peeling member. Therefore, the image forming materials cannot be removed therefrom if a shearing force greater than the cohesive force of the combination of the image forming materials and the thermoplastic layer. Since the cohesive force is very high, it is necessary to drive the peeling member using a high power motor or to use a large-size and heavy-weight thickness control member for controlling the thickness of the image forming materials on the peeling member. In addition, in this case the combination of the image forming materials and the thermoplastic layer is forcibly subjected to cohesion failure, and therefore the surface of the thermoplastic layer, from which the image forming materials are removed, is roughened. Therefore, problems in that an image on a recording material cannot be well removed and a projected portion of the roughened thermoplastic layer is adhered to a recording material are caused (namely, the cleaned peeling member has poor image removing ability) occur.

Referring to FIG. 2, the recording material 200 is set in a cassette 201 in a manner such that the image to be removed faces downward. The recording material 200 is fed one by one with a pickup roller 202. The recording material 200 is then fed by a pair of feeding rollers 203 toward the upstream removing device. The image on the recording material 200 is heated and pressed at the nip between the pressure roller 211 and the heat roller 212, and thereby the image achieves a plastic state. The image having a plastic state is adhered to the peeling member 217. The recording material 200 is separated from the peeling member 217 at an edge portion of the separating block 214, which has a curvature of about 2 mm. In this case, almost all of solid images, character images and middle to high half tone images in the image are transferred to the peeling member 217. The recording material 200 is then fed by a pair of feeding rollers 204 toward the downstream image removing device. In this case, the peeling member 217 is subjected to a cleaning treatment using the cleaning blade 310 to remove the image forming materials transferred on the surface of the peeling member 217 after every image transfer operation.

At the upstream image removing device, the image on the recording material is preferably heated to a temperature higher than the temperature thereof at the downstream image removing device. In this case, the fluidity of the image forming material constituting the image is heightened, and therefore a higher image portion is pressed, resulting lowering of the higher image portion. Therefore, a lower image portion such as low density half tone images can be contacted with the surface of the peeling member. Accordingly, almost all the image on the recording material can be transferred to the peeling member 217. However, when image forming materials, which are previously transferred to the peeling member, remain on the peeling member, the image forming materials tend to be re-transferred to the recording material 200 because the temperature of the peeling member is relatively high. This image re-transferring problem is easily caused if the residual image forming materials are secondary or tertiary color images. Therefore it is preferable to remove the image forming materials on the peeling member 217 after every image transferring operation. In this regard, it is not necessary to perfectly remove the image forming materials on the peeling member, but it is necessary to remove a part of the image forming materials so that the image forming materials on the peeling member has a smooth surface. When the image forming materials transferred on the peeling member 217 do not have a smooth surface, problems in that the image removing efficiency at the upstream peeling member deteriorates, and the life of the downstream peeling member is shortened due to transfer of the re-transferred image forming materials to the downstream peeling member are caused.

The recording material 200, which has been subjected to the image removing treatment by the upstream image removing device, is then subjected to a second image removing treatment by the downstream image removing device. When the second image removing treatment is performed, the surface of the downstream peeling member has a plasticity unlike the surface of the upstream peeling member. Therefore, the image remaining on the recording material 200, such as image forming particles which are scattered around images, image forming particles located in background areas (i.e., background fouling), and lower half tone images located near higher images, can be well removed.

As mentioned above, the temperature of the surface of the downstream peeling member is controlled so as to be lower than that of the surface of the upstream peeling member. When the temperature of the downstream peeling member is too high, a problem in that the recording material cannot be well separated from the peeling member, and the plastic layer of the peeling member is transferred to the recording material occurs. The temperature of the downstream peeling member is preferably 5 to 30° C. lower than that of the upstream peeling member. Specifically, the temperature of the downstream peeling member is preferably from 55 to 130° C.

In this embodiment of the image removing apparatus illustrated in FIG. 2, a controller (not shown) controls such that the cleaning operation for the downstream peeling member 227 is not performed after every image removing operation, and is performed intermittently. As mentioned above, the amount of the image forming materials transferred to the downstream peeling member 227 is small and in addition the surface of the image forming materials on the peeling member 227 is not so roughened. Therefore image removing operation can be well performed by the peeling member even if a cleaning operation is not performed after every image removing operation. In addition, as mentioned above the image forming materials on the downstream peeling member 227 are preferably removed therefrom after heating the peeling member to a temperature higher than that of the peeling member in the image removing operation. Therefore, if the cleaning operation is performed after every image removing operation, a large amount of energy is consumed for heating the peeling member, which is not preferable in view of energy saving.

It is more preferable to perform a cleaning operation on the downstream peeling member when the downstream peeling member does not perform an image removing operation or the image removing apparatus does not perform an image removing operation than to perform the cleaning operation parallel to the image removing operation. This is because the downstream peeling member is preferably heated to a temperature higher than the temperature at which the peeling member performs an image removing operation. Specifically, if a cleaning operation is performed on the downstream peeling member after every image removing operation, the peeling member is repeatedly heated to the cleaning temperature and then cooled to the image removing temperature. Therefore, it is necessary to provide a cooling device configured to cool the peeling member or to separate the cleaning section from the image removing section of the downstream peeling member, resulting in occurrence of problems such as jumboization and complication of the image removing apparatus and increase of costs of the apparatus.

In addition, it is impossible to perform a cleaning operation on the downstream peeling member 227 within one rotation of the peeling member, and it is necessary to rotate the peeling member from 5 to 200 revolutions while pressing the image forming material pressing roller 225 to the plastic layer of the peeling member 227 in order to move the image forming materials on the peeling member to one end or both ends of the peeling member (i.e., in order to reduce the thickness of the image forming materials on the peeling member to a proper thickness). In the cleaning operation, the peeling member is preferably rotated at a higher speed than that in the image removing operation to enhance the heat efficiency.

In the image removing apparatus illustrated in FIG. 2, a plastic layer thickness detector 207 checks the amount of the image forming materials remaining on the peeling member 227 after the image peeling operation. A controller (not shown) controls such that when the amount of the image forming materials on the peeling member is greater than a predetermined amount, a cleaning operation is performed on the peeling member 227.

In addition, the controller controls such that the cleaning operation is performed while rotating the peeling member 227 by 25 revolutions at a speed twice the speed of the peeling member in the image removing operation. The thickness sensor 207 illustrated in FIG. 2 measures the dislocation of the pressing roller 225 using a differential transformer, but is not limited thereto. Detectors in which dislocation of the pressing roller 225 is determined using laser light reflection can also be used for the sensor 207. Further, it is possible to directly measure the total thickness of the thermoplastic layer and the image forming materials on the peeling member with a differential transformer or a laser light reflection device which is set so as to face the peeling member. Furthermore, it is possible to use the following sensors:

(1) sensors in which the heat capacity of the peeling member 227, which changes depending on the thickness of the image forming materials on the peeling member, is determined by measuring the temperature of the peeling member at a position on an upstream side from the pressing roller 225 to determine the difference between the temperature and the temperature of the heating roller; and (2) sensors in which laser light irradiates the peeling member to measure the reflection light, i.e., to measure the optical density of the image forming materials on the peeling member 227.

The image removing apparatus can include a counter for counting the number of the image removing operations already performed on recording materials and a controller which resets the counter when a cleaning operation is performed on the downstream peeling member(s). The controller orders the cleaner to clean the surface of the downstream peeling member(s). Using such a controller prolongs the life of the cleaner and saves cleaning energy while imparting good image removing ability to the downstream peeling member(s) for a long period of time.

The number of recording materials to be subjected to the image removing operation without cleaning the downstream peeling member(s) (i.e., the processing ability of the downstream peeling member(s) without a cleaning operation) changes depending on factors such as the area proportion of low density half tone images in the images to be removed; peripheral length of the downstream peeling member(s); and image removing conditions of the upstream peeling member. If the peripheral length of the downstream peeling member is the same as the length of the recording material, the processing ability of the downstream peeling member(s) is from 100 to 1000 sheets (i.e., the downstream peeling member can perform 100 to 1000 image removing operations without a cleaning operation). If the images to be removed are general images, the processing ability of the downstream peeling member(s) is not less than 200 sheets.

Referring to FIG. 2, an image sensor 232 is provided to determine whether the treated recording material has a residual image. A controller (not shown) controls such that when the number (or area) of the residual image exceeds a predetermined value, a cleaning operation is performed on the downstream peeling member(s).

The recording material 200, which has been subjected to the image removing operation at the downstream image removing device, is fed by pairs of feed rollers 205 and 206 and is stacked on a tray 209. Numeral 208 denotes a recycled recording material and numeral 231 denotes image forming materials removed from the peeling member 227 by the cleaner 228.

The image removing apparatus illustrated in FIG. 2 includes two image removing devices. However, the image removing apparatus of the present invention is not limited thereto, and can include two or more image removing devices.

Next, the image removing apparatus of the present invention will be explained referring to FIG. 4. The image forming apparatus includes a web-form peeling member as a downstream peeling member.

Figure 4:
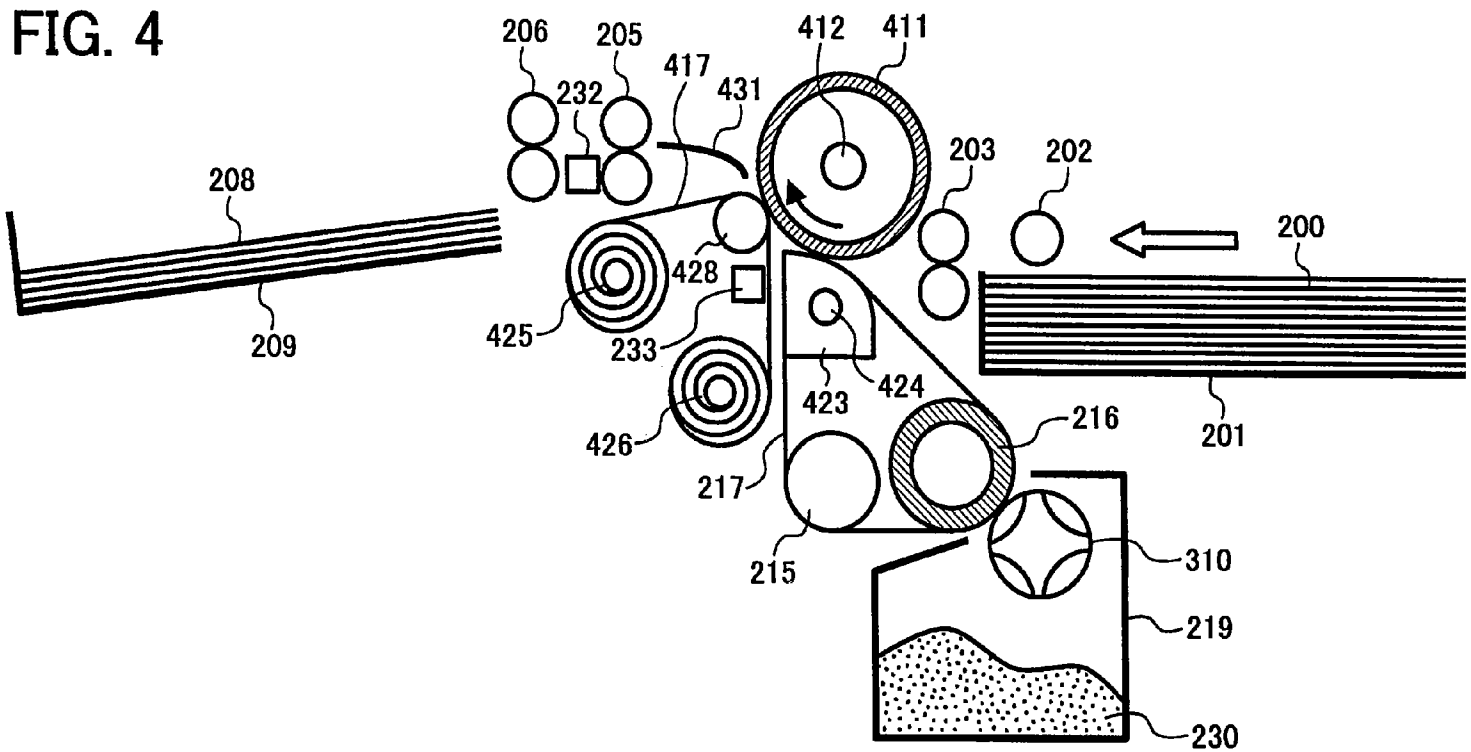
FIG. 4 is a schematic view illustrating another example of the image removing apparatus of the present invention.

In FIG. 4, since like reference characters designate like corresponding parts illustrated in FIG. 2, such parts are not explained here or are briefly explained. The apparatus includes an upstream image removing device including a heat/separation block 423 which is constituted of a metal such as aluminum and stainless steel and which includes a heater 424 such as halogen lamps and infrared lamps. A temperature sensor (not shown) measures the temperature of the surface of the heat/separation block 423, and the temperature information is input to a controller (not shown). The controller controls heat generation of the heater 424 according the temperature information to control the temperature of the surface of the heat/separation block 423 so as to fall in a predetermined range.

The uppermost image removing device further includes a pressure roller 411, which is also used for the downstream image removing device. The pressure roller 411 is, for example, a roller made of a metal such as aluminum and stainless steel and having a diameter of 50 mm and a thickness of 3 mm; and a heat resistant elastic layer which is located on the surface of the roller and which is made, for example, a rubber (such as silicone rubbers) having a thickness of 3 mm. In addition, a pressing device (not shown) such as springs, water pressurizers and air pressurizers is provided to press the pressure roller 411 to the heat/separation block 423. Therefore, the recording material 200 is pressed to the upstream peeling member 217 while heated. The pressure roller 411 includes a heater 412 therein.

The upstream image removing device includes the pressure roller 411, the heat/separation block 423, the heater 424, the peeling member 217 whose surface does not have a plasticity even when heated to the image removing temperature, the tension roller 215, the cleaning backup roller 216, the cleaning blade 310 and the container 219. The peeling member 217 is an endless belt which is tightly stretched by the heat/separation block 423, the tension roller 215 and the cleaning backup roller 216. The tension roller 215 is pressed at a predetermined pressure by a pressing device (not shown) such as springs, water pressurizers and air pressurizers. The heat/separation block 423 has an edge portion having a curvature of about 1 mm, at which the recording material 200 is separated from the peeling member 217 after being pressed at the nip between the pressure roller 411 and the heat/separation block 423. Since the peeling member 217 slides on the surface of the heat/separation block 423, the surface of the heat/separation block 423 is preferably coated with a material having a low friction coefficient (such as fluorine-containing resins), so that the peeling member 217 can be smoothly fed and foreign materials such as image forming materials and dust are not adhered to the surface of the heat/separation block 423.

The peeling member 217, cleaning backup roller 216, cleaning blade 310 and container 219 have the same configurations and functions as those of the parts illustrated in FIG. 2. Thus, the image on the recording material 200 is subjected to an image removing treatment at the upstream image removing device. Similarly to the first embodiment, the peeling member 217 is subjected to a cleaning treatment after every image forming operation.

The downstream peeling member 417 has a web-form, and is wound on cores 425 and 426. Therefore, a large number of image removing operations can be performed by one peeling member. The surface of the downstream peeling member 417 has a thermoplasticity. A separation/pressure roller 428, which is a roller having a diameter of about 10 mm, is pressed to the pressure roller 411 using a pressing device (not shown) such as springs, water pressurizers and air pressurizers to form a nip between the pressure roller 411 and the separation/pressure roller 428. The downstream peeling member 417 is contacted with the recording material 200, which has been subjected to an image removing treatment at the upstream image removing device, and the peeling member 417 and the recording material 200 are pressed and heated at the nip between the pressure roller 411 and the separation/pressure roller 428. Thus, the residual image on the recording material 200 is transferred to the peeling member 417. Then the recording material 200 is fed along a guide plate 431 and is discharged to the tray 209 by the pairs of feeding rollers 205 and 206.

In the image removing apparatus illustrated in FIG. 4, cleaning for the downstream peeling member 417 is not performed. Similarly to the first embodiment, the downstream peeling member 417 includes a thermoplastic resin layer thereon, which has a plasticity when heated. Specific examples of the substrate of the downstream peeling member 417 include films of polymers, which do not have a plasticity at a temperature in which the peeling member is heated, such as polyethylene terephthalate, polyethylene naphthalate, polyimide, polysulfone, polyether ether ketone, and polyphenylene sulfide; and papers including cellulose fibers. Among the materials for use as the substrate, papers are preferably used. In general, papers are porous and therefore has a good adhesiveness against layers of resins such as polyvinyl acetate resin, ethylene-vinyl acetate copolymers, styrene-acrylic resins, polyester resins, and nylon resins. Therefore, a problem in that the resin layer on the paper substrate is separated therefrom when the recording material 200 is separated from the peeling member 217 is not caused.

When a film of a resin such as polyethylene terephthalate, polyethylene naphthalate, polyimide, polysulfone, polyether ether ketone, and polyphenylene sulfide is used, there is a possibility that a problem in that the thermoplastic resin layer on the film is separated therefrom occurs when the peeling member 417 is cooled because the film and the thermoplastic resin layer have different heat expansion coefficients. It is effective for preventing occurrence of such a problem to form therebetween an intermediate layer having a heat expansion coefficient between the heat expansion coefficients of the thermoplastic resin layer and the substrate; and/or to subject the surface of the substrate to a treatment such as corona discharging treatments. When a paper is used for the substrate, such a problem is not caused even if an intermediate layer is not provided or a surface treatment is not performed on the substrate.

In addition, paper is low-cost, and can be recycled. Even when the used peeling member is incinerated, the environmental conditions are hardly deteriorated.

When such a resin film as mentioned above is used as the substrate of the downstream peeling member, it is preferable to collect the waste peeling member from users to reuse the peeling member after removing the image forming materials from the peeling member.

The web-form peeling member 417 wound on the core 426 is wound by the core 425. An end mark is formed at an end portion of the peeling member 417. When an end mark detector 233 detects the end mark, the pressure applied to the pressure roller 411 and the separation/pressure roller 428 is cancelled with a cancellation device (not shown) and the peeling member, the most part of which has been wound onto the core 425, is rewound by the core 426. Then the peeling member 417 is used again for the image removing operation. Similarly to the first embodiment, a portion of the web-form peeling member 417 having the same length (area) as that of the recording material 200 has an ability to perform the image removing operation on 100 to 1000 sheets of the recording material. In addition, it is possible to control such that after the peeling member is used for the image removing operation predetermined times, a signal of replacement of the peeling member with a fresh peeling member is displayed or such that when the amount of residual images on the recording material exceeds the predetermined amount, a signal of replacement of the peeling member with a fresh peeling member is displayed. In addition, it is also possible to control such that the amount of the image forming materials on the peeling member exceeds the predetermined amount, a signal of replacement of the peeling member with a fresh peeling member is displayed. By using such a device (method), the image removing apparatus can stably perform good image removing operations for a long period of time.

When one recording material is subjected to an image removing treatment, the amount of the image forming materials transferred onto the downstream peeling member is small but particles of the image forming material scattered around an image are adhered to the downstream peeling member. Therefore, there is a case where image information can be read from the particles of the image forming material on the peeling member as a reverse image. When cleaning of the peeling member is intermittently performed, the particles (i.e., the image information) remain on the downstream peeling member until the peeling member is subjected to a cleaning treatment. Therefore, if cleaning is not performed on the peeling member, the particles remain on the peeling member, which leads to leak of secret. Such a problem can be avoided by including a colorant such as dyes and pigments in the downstream peeling member 417 because the reverse image is not visible due to the color of the peeling member. In this case, it is preferable to include a black colorant such as carbon black and iron oxides or a mixture of plural different colorants in the thermoplastic layer of the downstream peeling member. When the thermoplastic layer is colored black, the reverse image formed thereon cannot be read whether or not the particles constituting the reverse image have a black color.

It is preferable to form a thermoplastic layer on both sides of the substrate of the downstream peeling member 417 to prolong the life of the peeling member. This is particularly preferable when a paper is used as the substrate of the peeling member, to effectively use the paper substrate, i.e., to decrease burdens on the environment. Images can be transferred onto the backside of the peeling member 417 by changing the positions of the cores 425 and 426 after the peeling member is repeatedly used and the image removing ability of the front thermoplastic layer deteriorates. In this case, it is preferable to display a signal such that the backside of the peeling member should be used. The time at which the peeling member should be used can be determined by checking the amount of the image forming materials on the peeling member 417 or by counting the number of times at which the peeling member is repeatedly used for image removing operations. By using this method, the image removing apparatus can stably perform good image removing operations for a long period of time.

In addition, it is possible not to operate the downstream peeling member(s) if the user of the image removing apparatus accepts the following recording materials:

(1) recording materials on which a small amount of residual images (such as background fouling and scattered image forming particles) still remain on the recording material;

(2) recording materials in which the recorded image is not perfectly removed but includes no secret information; and/or (3) recording materials in which the recorded image includes no low density half tone image and thereby almost all the image has been removed by the uppermost peeling member.

By using this method, the life of the downstream peeling member can be prolonged and in addition the energy used for the image removing operation of the downstream peeling member can be saved, resulting in decrease of burdens on the environment. Therefore, it is preferable to provide a controlling device by which the user can select whether or not to perform an image removing operation using the downstream peeling member and an interface. For example, such suspension of the image removing operation can be made by turning on/off the heater 223 of the heat roller 223 illustrated in FIG. 2 or detaching the pressure roller 221 from the heat roller 222. Specifically, when the heater 223 is turned off and thereby the temperature of the heat roller 222 is lowered below a certain temperature, the image on the recording material is not transferred onto the peeling member at all even if the pressure applied to the pressure roller 221 and the heat roller 222 is not cancelled. Therefore, the downstream peeling member does not perform the image removing operation. In the image removing apparatus illustrated in FIG. 4, such suspension of the image removing operation can be made by cancel the pressure applied to the separation/pressure roller 428 and the pressure roller 411.

When the user accepts that a small amount of residual image forming materials are present on the recording material, the residual images (such as background fouling and scattered image forming particles) tend to be accumulated on the recording material after several repeated use (i.e., after performing image formation and image removal several times on the same recording material). Therefore, an image formed on such a recording material has poor visibility. Therefore, it is preferable for the image removing apparatus to include a detector which can determine how many times the same recording material is repeatedly used for image formation and a recording device configured to record the repeat number information on the repeat times on the recording material. In this case, it is preferable that when the number of repetitions exceeds a predetermined number, the downstream peeling member is subjected to a cleaning treatment. By using this method, the life of the downstream peeling member and the cleaning device therefor can be prolonged, and the energy used for operating the downstream peeling member can be reduced.

The repeat number information can be recorded on the recording material, for example, by using one of the following methods:

(1) an inkjet recording device which discharges a dye ink toward the recording material or a stamper is provided just before the tray 209; and (2) an IC chip is installed in a special paper sheet and information on the repeat number is recorded therein by a recorder.

The optical information on the repeat number recorded on the recording material can be read with a combination of a light emitting device (such as LEDs) and a light receiving device (such as CCDs). When the image is recorded in an IC chip, the information is read using a special reading device therefor. An information reader configured to read such information on the repeat number recorded on the recording material is preferably arranged just before the uppermost stream peeling member. In this case, whether or not to operate the downstream peeling member can be determined according the information the repeat number recorded on the recording material.

The recording materials used for the image removing apparatus of the present invention are not particularly limited, and various kinds of recording materials can be used. In particular, when images formed on plain papers are removed, it is preferable to provide an applicator configured to apply an image removal accelerating liquid including water and a surfactant to the recording papers before uppermost stream image removing device. By applying such an image removal accelerating liquid to the recording paper before an image removing operation, water swells the cellulose fibers in the recording paper, thereby forming a shearing force between the paper and the image forming material thereon. Therefore, the adhesiveness of the image forming material to the recording paper can be decreased, and the image can be easily removed from the recording material. With respect to the image removal accelerating liquid and applicator therefor, a proper liquid and a proper applicator can be chosen from known image removal accelerating liquids and applicators. Therefore, images formed on plain papers can be well removed using such a proper image removal accelerating liquid and an applicator therefor.

However, recently the particle diameter of image forming materials constituting images becomes smaller and smaller and in addition multi-color images are often formed. Therefore, it becomes hard to perfectly remove such images on a plain paper. Specifically, when an image is formed on a plain paper using an image forming material (such as toners) having a volume average particle diameter of not greater than 8 μm (particularly a spherical toner prepared by a suspension polymerization method, or a dispersion polymerization method), the particles of the image forming material are contained in recessed portions present on the surface of the plain paper, which is porous. Therefore, even when a peeling member having a thermoplastic layer thereon is used, the particles in the recessed portions cannot be well removed therefrom. Therefore, when such a plain paper is repeatedly used as the recording material, the amount of the particles in the recessed portions increases. Therefore, such a plain paper cannot be re-used many times. In addition, the amount of the residual particles present on such recessed portions is larger in an area of the paper in which an image was formed than in an area of the paper corresponding to the background area of the image. Therefore, the recording paper includes the image information even after the image removing operation, which results in leak of secret.

In addition, when a multi-color image is formed, the image is heated upon application of heat energy thereto, which is higher than the heat energy applied to monochrome images to decrease the viscosity of the color toner images, resulting in improvement of the color reproducibility of the multi-color image. Even when an image removal accelerating liquid including water as a main component is used for such a multi-color image, the liquid cannot penetrate the image layer. Therefore, the liquid cannot reach the interface between the image and the recording paper, and therefore the adhesiveness of the image to the recording paper cannot be decreased. Thus, images formed on plain papers cannot be perfectly removed therefrom even if an image removal accelerating liquid is used. By coating such a liquid from the backside of the recording paper, the liquid can reach the interface between the image and the recording paper. However, in this case a large amount of image removal accelerating liquid has to be applied, and thereby the recording paper is increased in length, resulting in occurrence of problems such as curling and formation of wrinkles. In addition, high heat energy has to be applied for drying the liquid.

There is a proposal to use an image removal accelerating liquid capable of swelling image forming materials instead of recording materials. However, in general the image forming materials for use in electrophotography are not hydrophilic but are lipophilic. Therefore, it is necessary for the image removal accelerating liquid to include an organic solvent. This is a problem in view of health and safety, and in addition the liquid has a high cost.

Specific examples of the materials for use as the recording material include not only paper-based recording materials but also synthetic papers made of a material such as polypropylene, and films of resins such as polyethylene terephthalate, polypropylene and cellulose acetate. When synthetic papers and resin films are used as the recording material, images thereon can be well removed by the image removing method and apparatus of the present invention because the surface of the recording material is smooth. However, synthetic papers and resin films have the following drawbacks:

(1) costs thereof are high;
(2) it is troublesome to dispose of them; and
(3) since charges therein hardly decay, the user often receives electric shock.

In order to avoid the problems caused by plain papers, synthetic papers and resin films, it is preferable to use so-called "reusable paper" which includes a paper substrate and a layer located thereon and configured to decrease the adhesiveness of an image forming material to the paper substrate or which includes a paper substrate and a compound capable of decreasing the adhesiveness of an image forming material to the paper substrate is penetrated in the paper substrate.

Suitable materials for use as the recording material in the present invention include the following:

(1) recording materials on which a silicone compound is coated (disclosed in, for example, JP-As 09-204060 and 09-204061); and
(2) a surfactant is coated on a paper substrate (disclosed in, for example, JP-A 10-74025).

Suitable surfactants for use in the recording material (i.e., recording papers) include fluorine-containing surfactants, silicone surfactants, and surfactants having one or more alkyl groups having eight or more carbon atoms in total in the main chain and/or side chains of one molecule thereof.

Specific examples of the fluorine-containing surfactants include anion surfactants such as fluoroalkyl carboxylic acid salts, and fluoroalkyl sulfonic acid salts; ampholytic surfactants such as fluoroalkyl-containing betaine; nonionic surfactants; and cationic surfactants. Specific examples of the silicone surfactants include epoxy-modified silicone oils, alkyl-modified silicone oils, aralkyl-modified silicone oils, amino-modified silicone oils, carboxyl-modified silicone oils, alcohol-modified silicone oils, fluorine-containing silicone oils, polyether-modified silicone oils, etc. Specific examples of the surfactants having one or more alkyl groups having eight or more carbon atoms include anionic surfactants such as carboxylic acid salts, sulfuric acid salts, sulfonic acid salts, and phosphoric acid salts; cationic surfactants such as amine salts, amine derivatives, quaternary ammonium salts, imidazoline, and imidazolium salts; and ampholytic surfactants such as betaine.

By coating such surfactants on a recording material such as papers, the adhesiveness of an image to the recording material can be decreased. The weight of the coated surfactant is changed depending on the specie of the surfactant used. Even when one or more of the surfactants mentioned above are coated on a recording material, there is a case where the adhesiveness of an image to the recording material cannot be decreased to an extent such that the image can be easily removed therefrom. In this case, it is preferable to change the structure (length of the alkyl group included therein and/or the degree of branching) of the surfactant and/or HLB of the surfactant.

It is also preferable to coat a wax emulsion, which is prepared by dispersing a wax such as carnauba waxes, bees waxes, and polyethylene waxes in water, on a recording material such as papers.

As a result of the present inventor's study, it is preferable to use, as a reusable paper, a recording material having a surface coated with a mixture of a polymer, which is prepared by saponifying a reaction product of an α-olefin with maleic anhydride, and a binder resin such as polyacrylic acid resins, polyvinyl alcohol resins, starches, oxidized starches, natural or synthesized latexes, and polyvinyl acetate emulsions. This is because image forming materials can be well removed from the recording material; and the recording material has low cost and high safety. The weight of the material coated on (or penetrated into) one side of the recording material is not less than 2 g/m$^2$, and preferably from 2 to 6 g/m$^2$. By coating such a coating liquid on a plain paper, the recessed portions present on the surface of the paper are filled with the coating material. Therefore, even when an image forming material having a volume average particle diameter of not greater than 8 μm (for example, a diameter of from 3 to 8 μm) is used, the image can be well removed by the image removing method and apparatus of the present invention. In addition, when the above-mentioned reusable paper is used, the image removing method and apparatus of the present invention can clearly remove multi-color images formed on the reusable paper.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed to prepare a coating liquid.

| | |
|---|---|
| 25% by weight aqueous solution of olefin-maleic anhydride copolymer | 1 part |
| 10% by weight aqueous solution of polyvinyl alcohol | 10 parts |

The coating liquid was coated on both sides of a plain paper (TYPE 6200 from Ricoh Co., Ltd.) using a wire bar, followed by drying at 120° C. for 5 minutes. The weight of the coated layer was 3.5 g/cm$^2$ on a dry basis per one side. The coated paper was then subjected to a treatment using a super calender to smooth the coated paper. Thus, a reusable paper was prepared.

The thus prepared reusable paper was set in an electrophotographic full color image forming apparatus (IMAGIO NEO C385 from Ricoh Co., Ltd.) and copies of a full color image having half tone images consisting of dot images whose area proportion is changed from 0% (white solid image) to 100% (black solid image) at an interval of 10%; a half tone image having an area proportion of 30% sandwiched by secondary color images; character images; and solid images were produced. The resultant copies had clear images. In this regard, the toner having a volume average particle diameter of 6.8 μm was used.

The images formed on the reusable paper were removed by the image removing apparatus illustrated in FIG. 2. The conditions of the apparatus were as follows.

Image removing speed: 40 mm/sec

Conditions of Upstream Image Removing Device

Peeling member: polyimide film having thickness of 100 μm

Image forming material removing blade: spiral cleaning blade as illustrated in FIG. 3, which is made of steel and has diameter of 25 mm Material of surface of the backup roller: urethane sponge Rotation direction of cleaning blade: direction opposite to the direction of the peeling member Temperature of the heat roller: 135° C.

Conditions of Downstream Image Removing Device

Peeling member: polyimide film having thickness of 100 μm on which a layer of the black toner of IMAGIO NEO C385 having a thickness of 6 μm was formed.

Cleaning interval: cleaning was performed on the peeling member after every 300 image removing operations Temperature of cleaning backup roller: 165° C.

Image forming material pressing roller: a roller in which the central portion thereof has a diameter of 30 mm and both ends thereof has a diameter of 29.5 mm Temperature of heat roller: 110° C.

As a result, the images formed on the reusable paper were perfectly removed.

The procedure for the image formation and the image removal mentioned above was repeated 50 times using the same reusable paper. As a result, qualities of the images formed thereon were not changed (i.e., clear images were formed) and in addition the images were perfectly removed.

Comparative Example 1

The procedure for the image formation and the image removal in Example 1 was repeated except that the heater in the heat roller of the downstream image removing device was turned off (i.e., the image removing operation of the downstream image removing device was not performed).

As a result, the half tone images having an area proportion of not less than 30%, character images and solid images were removed, but the half tone images having an area proportion of 10% and 20%, the half tone image sandwiched by secondary color images, and scattered toner particles around images could not be removed. It was found by observing the images with a microscope of 100 power magnification that toner particles are present on the background area.

Comparative Example 2

The procedure for the image formation and the image removal in Example 1 was repeated except that the heater in the heat roller of the upstream image removing device was turned off (i.e., the image removing operation of the upstream image removing device was not performed).

As a result, the half tone images, character images and solid images were removed, but the half tone image sandwiched by secondary color images remained without being removed (i.e., the half tone image could be visually observed).

Comparative Example 3

The procedure for the image formation and the image removal in Example 1 was repeated except that the heater in the heat roller of the upstream image removing device was turned off (i.e., the image removing operation of the upstream image removing device was not performed).

A portion of the downstream peeling member to which the residual image on the reusable paper was transferred was cut and the portion was adhered on the upstream peeling member using an adhesive tape. Then the upstream peeling member having the portion of the downstream peeling member thereon was subjected to the cleaning treatment to determine whether the image transferred on the portion of the downstream peeling member can be removed by the cleaner 310 illustrated in FIG. 2. As a result, the image on the portion could not be removed at all. Therefore, it was found that image forming materials on the thermoplastic layer of the downstream peeling member cannot be removed by a method using a sliding blade (such as the cleaner 310).

In addition, the procedure for the image formation and the image removal in Example 1 was repeated except that the heater in the heat roller of the upstream image removing device was turned off (i.e., the image removing operation of the upstream image removing device was not performed), and five copies of the above-mentioned original image were continuously subjected to the image removing operation in the image removing apparatus without performing cleaning on the downstream peeling member.

As a result, the images transferred to the downstream peeling member were re-transferred to the background areas of the third and fourth sheets of the reusable paper. In addition, the fifth sheet was jammed in the image removing apparatus because the sheet could not be well separated from the downstream peeling member. Therefore, it was found that when only a peeling member having a thermoplastic layer thereon is used for image removing, images other than images having steps (such as half tone images sandwiched by secondary color images) can be well removed (as can be understood from Comparative Example 2), but a problem in that image forming materials on the peeling member are re-transferred on a recording material if cleaning is not performed on the peeling member occurs.

Comparative Example 4

The procedure for the image formation and the image removal in Example 1 was repeated except that the temperature of the heat roller of the downstream image removing device was changed to 135° C., which is the same as that of the heat roller of the upstream image removing device.

As a result, a problem in that the thermoplastic layer of the downstream peeling member was transferred on the treated recording material, i.e., the recording material was soiled with the image forming materials.

Comparative Example 5

The procedure for the image formation and the image removal in Example 1 was repeated except that the temperature of the heat roller of the upstream image removing device was changed to 110° C., which is the same as that of the heat roller of the downstream image removing device.

As a result, the image on the reusable paper was perfectly removed therefrom and background fouling was not visually observed.

Further, the image removing operation was continued while the heater of the heat roller of the downstream image removing device was turned off (i.e., the downstream image removing device did not perform the image removing operation).

As a result, the half tone images having an area proportion of not less than 60%, character images, and solid images could be removed, but the half tone images having an area proportion of not greater than 50% remained without being removed. In addition, the area of the residue of the half tone image sandwiched by secondary color images was greater than that in Comparative Example 1.

Thus, it was found that when the image removing operation is performed while the temperature of the heat roller of the upstream image removing device is set to the same temperature as that of the downstream image removing device, the cleaning operation has to be frequently performed on the downstream peeling member because the amount of the image forming materials removed by the upstream peeling member is reduced.

Comparative Example 6

An image having character images and solid images without half tone images was formed on the reusable paper prepared in Example 1 using a full color electrophotographic image forming apparatus (IMAGIO NEO C385 from Ricoh Co., Ltd.)

The procedure for the image removing operation in Comparative Example 2 was repeated to remove the image from the reusable paper.

As a result, the toner particles scattered around the character image and solid images remained on the reusable paper without being removed.

The image forming operation and image removing operation mentioned above were repeated 15 times on the same reusable paper sheet while the downstream peeling member was not cleaned.

As a result, the residual toner particles were accumulated on the reusable paper, i.e., the reusable paper was soiled with toner particles, to an extent such that the reusable paper cannot be practically used.

Example 2

The image removing operation performed in Example 1 was performed on the reusable paper which had been used in Comparative Example 6 and which is soiled with toner particles, under the same conditions as those in Example 1.

As a result, the toner particles on the reusable paper could be perfectly removed. Specifically, the toner particles present on the background area (which cause the background fouling); and the toner particles scattered around character images and solid images could be clearly removed from the reusable paper.

Therefore, it was found that when images having character images and solid images without half tone images are removed, an image removing method in which the downstream peeling member is activated at a predetermined interval (which is determined depending on the degree of soiling of the recording material) can be used.

Example 3

The following components were mixed to prepare a coating liquid.

| | |
|---|---|
| 25% by weight aqueous solution of olefin-maleic anhydride copolymer | 16 parts |
| 12% by weight aqueous solution of oxidized starch | 16 parts |
| 40% by weight styrene-butadiene latex | 3 parts |

The coating liquid was coated on both sides of a plain paper (ECO G WHITE 100 from Oji Paper Co., Ltd.) using a wire bar, followed by drying at 120° C. for 5 minutes. The weight of the coated layer was 4.0 g/cm$^2$ on a dry basis per one side. The coated paper was then subjected to a smoothing treatment using a super calender to smooth the coated paper. Thus, a reusable paper was prepared.

The thus prepared reusable paper was set in an electrophotographic full color image forming apparatus (IMAGIO NEO C240 from Ricoh Co., Ltd.) and copies of a full color image having half tone images consisting of dot images whose area proportion is changed from 0% (white solid image) to 100% (black solid image) at an interval of 10%; a half tone image having an area proportion of 30% sandwiched by secondary color images; character images; and solid images were produced. The resultant copies had clear images. In this regard, the toner having a volume average particle diameter of 6.8 μm was used.

The images formed on the reusable paper were removed by the image removing apparatus illustrated in FIG. 4. The conditions of the image removing apparatus were as follows.

Image removing speed: 60 mm/sec

Conditions of Upstream Image Removing Device

Peeling member: polyimide film having thickness of 100 μm

Image forming material removing blade: spiral cleaning blade as illustrated in FIG. 3, which is made of steel and has diameter of 25 mm Material of surface of the backup roller: urethane sponge Rotation direction of cleaning blade: direction opposite to the direction of the peeling member Temperature of the heat roller: 145° C.

Conditions of Downstream Image Removing Device

Peeling member: paper having thickness of 70 μm on both sides of which layers of the magenta toner, cyan toner, yellow toner and black toner of IMAGIO NEO C240 having a thickness of 25 μm in total were overlaid.

Temperature of heat roller: 110° C.

As a result, the images formed on the reusable paper were perfectly removed.

The procedure for the image formation and the image removal mentioned above was repeated 50 times using the same reusable paper. As a result, qualities of the images formed thereon were not changed (i.e., clear images were formed) and in addition the images were perfectly removed.

This document claims priority and contains subject matter related to Japanese Patent Application No. 2005-072007, filed on Mar. 14, 2005, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image removing apparatus comprising:

a heating device configured to heat a recording material having thereon an image including a thermoplastic material to a temperature at which the thermoplastic material has a plasticity; and at least two image removing devices which are arranged in series in a feeding direction of the recording material, each of the at least two image removing devices comprising:

a peeling member configured to peel at least a portion of the image from the recording material;

a pressing member configured to pressure-contact the peeling member with a surface of the recording material, on which the image is formed, while the thermoplastic material in the image maintains a plasticity; and a transfer member configured to separate the peeling member from the recording material to transfer the portion of the image to the peeling member, wherein an uppermost stream peeling member has a first outermost layer which does not have a plasticity when being pressure-contacted with the recording material, and at least one downstream peeling member has a second outermost layer which has a plasticity when being pressure-contacted with the recording material.

2. The image removing apparatus according to claim 1, further comprising:

a cleaner configured to clean a surface of the uppermost stream peeling member after every image removing operation of the uppermost stream peeling member to remove at least a portion of the image on the uppermost stream peeling member.

3. The image removing apparatus according to claim 1, further comprising:

a cleaner configured to intermittently clean a surface of the at least one downstream peeling member to remove at least a portion of the image on the at least one downstream peeling member.

4. The image removing apparatus according to claim 3, further comprising:

a thickness detector configured to detect a thickness of the image on the surface of the downstream peeling member; and a controller configured to control the cleaner to perform the cleaning operation only after the thickness of the image on the at least one downstream peeling member exceeds a predetermined thickness.

5. The image removing apparatus according to claim 3, further comprising:

an image detector configured to detect a quantity of the image transferred to the at least one downstream peeling member; and a controller configured to control the cleaner to perform the cleaning operation only after the quantity of the image on the downstream peeling member exceeds a predetermined quantity.

6. The image removing apparatus according to claim 3, further comprising:

a counter configured to count a number of times of the image peeling operation performed by the at least one downstream peeling member; and a controller configured to control the cleaner to perform the cleaning operation only after the number of times of the image peeling operation exceeds a predetermined time.

7. The image removing apparatus according to claim 3, further comprising:

a controller configured to control the cleaner to perform the cleaning operation when the at least one downstream peeling member does not perform the image peeling operation.

8. The image removing apparatus according to claim 3, further comprising:

a controller configured to control the cleaner to perform the cleaning operation while raising a temperature of the at least one downstream peeling member so as to be higher in the cleaning operation than a temperature thereof at which the at least one downstream peeling member performs the image peeling operation.

9. The image removing apparatus according to claim 3, wherein the cleaner comprises:

a pressing member configured to press a surface of the at least one downstream peeling member so that the image transferred on the at least one downstream peeling member moves to an end of the at least one downstream peeling member; and a scraper configured to scrape off the image at the end of the at least one downstream peeling member.

10. The image removing apparatus according to claim 1, wherein the at least one downstream peeling member has a paper substrate including cellulose fibers as a main component.

11. The image removing apparatus according to claim 1, wherein the at least one downstream peeling member is a web having plural surfaces each having an outermost layer which has a plasticity when being contacted with the recording material.

12. The image removing apparatus according to claim 1, further comprising:

at least one heater configured to heat the uppermost stream peeling member and the at least one downstream peeling member; and a controller configured to control the at least one heater to heat the peeling members such that a temperature of the at least one downstream peeling member pressure-contacted with the recording material is lower than a temperature of the uppermost stream peeling member pressure-contacted with the recording material.

13. The image removing apparatus according to claim 1, further comprising:

an attaching and detaching member configured to attach the at least one downstream peeling member to the recording material and detach the peeling member therefrom; and a controller configured to control the at least one downstream peeling member to perform or not to perform the image peeling operation using the attaching and detaching member.

14. The image removing apparatus according to claim 1, further comprising:

a heater configured to heat the at least one downstream peeling member; and a controller configured to control a temperature of the downstream peeling member by controlling the heater.

15. The image removing apparatus according to claim 1, further comprising:

either an attaching and detaching member configured to attach the at least one downstream peeling member to the recording material and detach the peeling member therefrom or a heater configured to heat the at least one downstream peeling member;

a history detecting member configured to determine a history of the recording material; and a controller configured to control the attaching and detaching member or the heating member so that the at least one downstream peeling member performs the image peeling operation depending on the history of the recording material.

16. The image removing apparatus according to claim 1, wherein the at least one downstream peeling member includes a paper substrate, and wherein the second outermost layer located on the paper substrate includes a thermoplastic resin.

17. The image removing apparatus according to claim 16, wherein the at least one downstream peeling member further includes a colorant.

18. The image removing apparatus according to claim 17, wherein the colorant is a black colorant.

* * * * *